US009453378B2

(12) United States Patent
Ge

(10) Patent No.: US 9,453,378 B2
(45) **Date of Patent: *Sep. 27, 2016**

(54) SPINNER ASSEMBLY FOR OILFIELD TUBULAR CONNECTIONS

(71) Applicant: Yaogen Ge, Katy, TX (US)

(72) Inventor: Yaogen Ge, Katy, TX (US)

( * ) Notice: Subject to any disclaimer, the term of this patent is extended or adjusted under 35 U.S.C. 154(b) by 256 days.

This patent is subject to a terminal disclaimer.

(21) Appl. No.: 14/202,236

(22) Filed: Mar. 10, 2014

(65) Prior Publication Data

US 2014/0245867 A1 Sep. 4, 2014

Related U.S. Application Data

(63) Continuation-in-part of application No. 11/120,720, filed on May 3, 2005, now Pat. No. 8,667,869.

(51) Int. Cl.
*E21B 19/16* (2006.01)

(52) U.S. Cl.
CPC ..... *E21B 19/168* (2013.01)

(58) Field of Classification Search
CPC .... E21B 19/164; E21B 19/16; E21B 19/168; E21B 19/161; E21B 19/10; E21B 19/163; E21B 3/04
See application file for complete search history.

(56) References Cited

U.S. PATENT DOCUMENTS

| | | | | |
|---|---|---|---|---|
| 4,446,761 A * | 5/1984 | Boyadjieff | ..... | E21B 19/168 81/57.19 |
| 8,667,869 B2 * | 3/2014 | Ge | ..... | E21B 19/168 81/57.15 |
| 2005/0076744 A1 * | 4/2005 | Pietras | ..... | E21B 19/163 81/57.16 |
| 2015/0167409 A1 * | 6/2015 | Gerwing | ..... | E21B 19/163 81/57.34 |

* cited by examiner

*Primary Examiner* — Robert Scruggs
(74) *Attorney, Agent, or Firm* — Egbert Law Offices, PLLC

(57) ABSTRACT

A spinner assembly for threading or unthreading tubular members above the floor of a well site has a spinner with an open throat, a plurality of rollers rotatable about a substantially vertical axis, a motor for driving the plurality of rollers, and a plurality of brackets supporting the plurality of rollers. The open throat is suitable for receiving one of the tubular members therein. The spinner housing has a common axis. The plurality of rollers are adapted to engage the tubular member received in the open throat. The brackets are disposed within the spinner housing on opposite sides of the open throat. The brackets are movable inwardly and outwardly of the spinner housing in opposite directions at a substantially straight line along the common axis.

13 Claims, 11 Drawing Sheets

SPINNER ASSEMBLY FOR OILFIELD TUBULAR CONNECTIONS

CROSS-REFERENCE TO RELATED APPLICATIONS

The present application claims priority from U.S. patent application Ser. No. 11/120,720, filed on May 3, 2005, and entitled "Spinner Assembly for Oilfield Tubular Connections", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to equipment and techniques for threading and unthreading oilfield tubular members, such as drill pipe, which are run into and out of a well. More particularly, the invention relates to a spinner of a type used with a power tong and a backup tong supported on the floor of an oilfield rig.

2. Description of Related Art Including Information Disclosed Under 37 CFR 1.97 and 37 CFR 1.98.

Various types of equipment has been devised for making up and breaking apart oilfield tubular members at a well site. U.S. Pat. No. 4,005,621 discloses a power tong for rotating tubular members. The power tong includes three circumferentially spaced jaws. A closed power tong with a plurality of jaws as disclosed in U.S. Pat. No. 5,000,065.

In other applications, a spinner tool having a plurality of rollers is used for engaging a tubular member to rotate the tubular member, with high torque for final making up and breaking apart the threaded connection being provided by other equipment. U.S. Pat. No. 4,446,761 discloses a spinner assembly for rotating oilfield tubular goods. U.S. Pat. No. 3,799,009 discloses an assembly comprising a spinner, a tong for making up or breaking apart the connection, and a backup tong for securing the lower pipe in position. U.S. Pat. No. 5,054,500 discloses a spinner assembly with toothed belts for driving rollers.

U.S. Pat. No. 5,791,206 discloses a breakout wrench for making and breaking joints between successive lengths of drill pipe. More particularly, circumferentially spaced dies engage the drill pipe.

One type of assembly including an upper spinner, an intermediate power tong for making up and breaking apart the threaded connection, and a lower tong is referred to as an "iron roughneck." U.S. Pat. No. 6,206,096 discloses an iron roughneck assembly, and more particularly a spinner with a plurality of rollers for rotating an upper tubular member. U.S. Pat. No. 6,253,845 discloses various embodiments for a roller of a spinner assembly.

The problems with the prior art equipment involved in threading and unthreading oilfield tubular members involve the high cost of manufacturing equipment, the complicated nature of the equipment which requires high maintenance, and the time and expense associated with replacing worn rollers in the spinner assembly.

The disadvantages of the prior art are overcome by the present invention, and an improved spinner assembly is hereinafter disclosed for threading and unthreading oilfield tubular connections.

These and other objects and advantages of the present invention will become apparent from a reading of the attached specification and appended claims.

BRIEF SUMMARY OF THE INVENTION

The present invention is a spinner assembly for threading or unthreading tubular members above the floor at a well site. The spinner assembly includes a spinner housing having an open throat, a plurality of rollers rotatable about a substantially vertical axis, a means for driving the plurality of rollers, and a plurality of brackets supporting the plurality of rollers. The spinner housing has an open throat suitable for receiving one of the tubular members therein. The spinner housing has a common axis. The plurality of rollers are adapted to engage with the tubular member received in the open throat. The brackets are disposed within the spinner housing on opposite sides of the open throat. These brackets are movable inwardly and outwardly of the spinner housing in opposite directions at a substantially straight line along the common axis.

In the present invention, there is also a plurality of actuators that are respectively connected to the plurality of brackets. Each of the actuators is connected to the spinner housing and is cooperative with the respective bracket such that the actuators serve to move the brackets in a substantially straight line.

In the present invention, a variety of techniques can be employed as the "means for driving". In particular, a motor can be cooperative at the rollers so as to rotate the rollers. The motor can be connected to the plurality of rollers by at least one gear. The motor can be connected by at least one shaft to the plurality of rollers. The motor can also be connected to the plurality rollers by a plurality of shafts and a plurality of gears.

In the present invention, at least one of the plurality of rollers can be a cordless roller. Alternatively, or in conjunction therewith, at least one of the plurality of rollers can be a solid roller.

The shaft can have a polygonal-shaped cross section or a round cross section. In those circumstances where the shaft has a round cross section, the shaft can have a key extending therefrom so as to be engaged with a keyway of a central passageway of the roller. The roller can have a central passageway of a polygonal shape. Under those circumstances, the shaft can have a polygonal shape received within the central passageway of the roller. The roller can also the central passageway of a round shape with a key or a keyway formed therein. The shaft has a key or a keyway formed thereon. The shaft is received in the central passageway of the roller such that the key of the shaft is received by the keyway of the roller or in which the key of the roller is received by the keyway of the shaft.

Each of the rollers may have two or more axially-spaced cylindrical portions in which a lower end of an upper cylindrical portion engages an upper end of a lower cylindrical portion. Each cylindrical portion can have first and second arcuate members each having a generally semi-cylindrical exterior surface and end surfaces adjacent ends of a respective exterior surface. The end surfaces of the arcuate members are in planar engagement. The end surfaces of the upper cylindrical portion are circumferentially offset from the end surfaces of a lower cylindrical portion. A plurality of securing members each extend axially between the two or more axially spaced portions and interconnect the two or more cylindrical portions.

The spinner assembly includes a pair of opposing actuators each for moving a pair of rollers into and out of engagement with an oilfield tubular member. A mounting bracket is provided for supporting a pair of rollers and the corresponding motor. The mounting bracket is pivotal with respect to the respective actuator so as to obtain contact between the pair of rollers and the tubular member.

This foregoing Section is intended describe, with particularity, the preferred embodiment of the present invention. It is understood that modifications to this preferred embodiment can be made within the scope of the present invention without departing from the spirit of the present invention. As such, this Section should not be construed, in any way, as limiting of the broad scope of the present invention. The present invention should only be limited by the following claims and their legal equivalents.

DETAILED DESCRIPTION OF THE INVENTION

Figure 1:
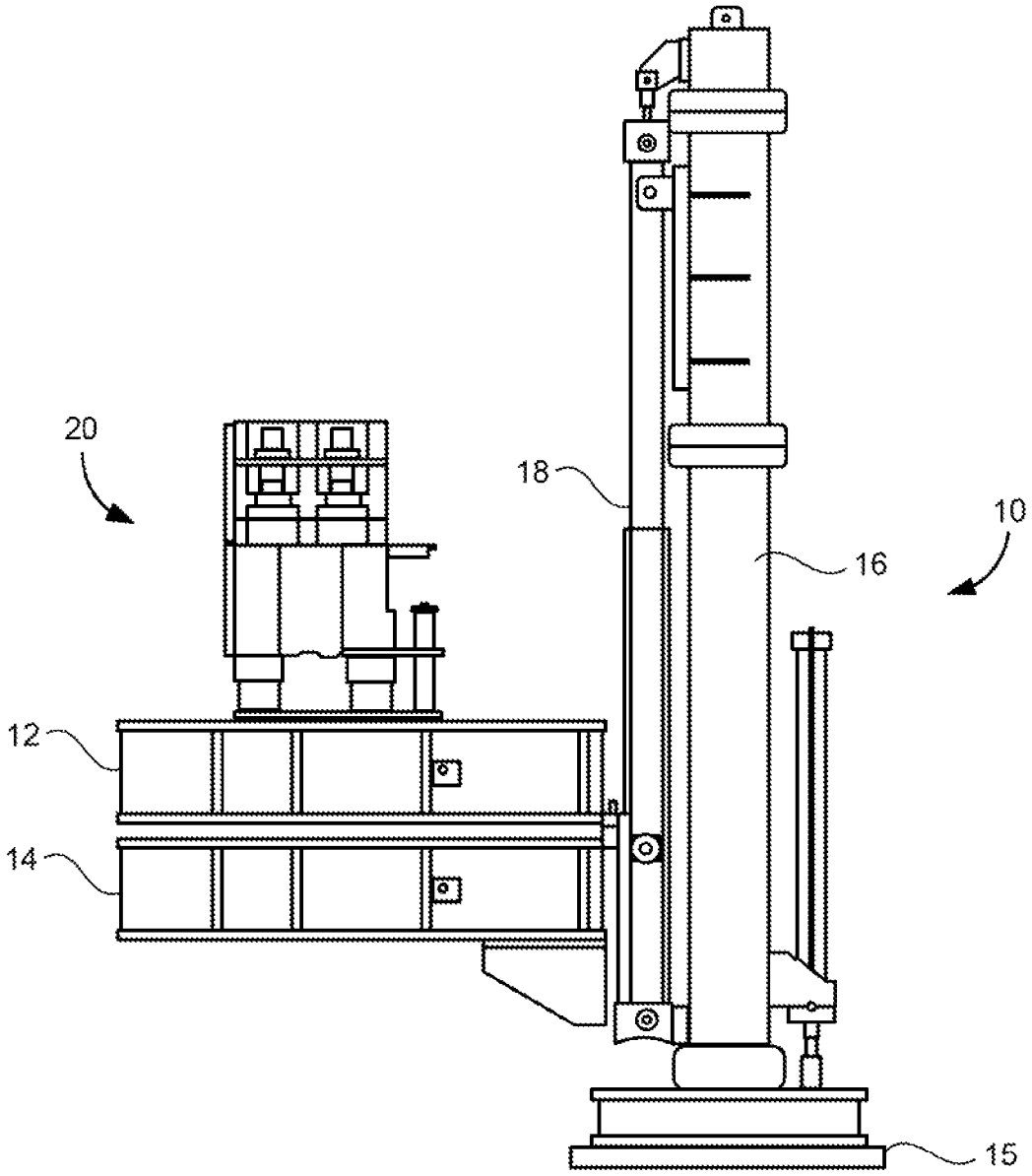
FIG. 1 is a simplistic side view of equipment according to the present invention for making up and breaking apart oilfield tubular connections.

FIG. 1 illustrates a tubular makeup and breakout assembly 10 for positioning on a rig floor at a well site. Those skilled in the art will appreciate that a substantially vertical oilfield tubular string comprising threaded joints or members may be received within a top spinner 20, an intermediate power tong 12 for final makeup and breakout of the threads, and a lower backup tong 14. Base 15, vertical post 16, and linkage arms 18 support the spinner and tongs, and allow both lateral and axial (vertical) movement with respect to the rig floor.

Figure 2:
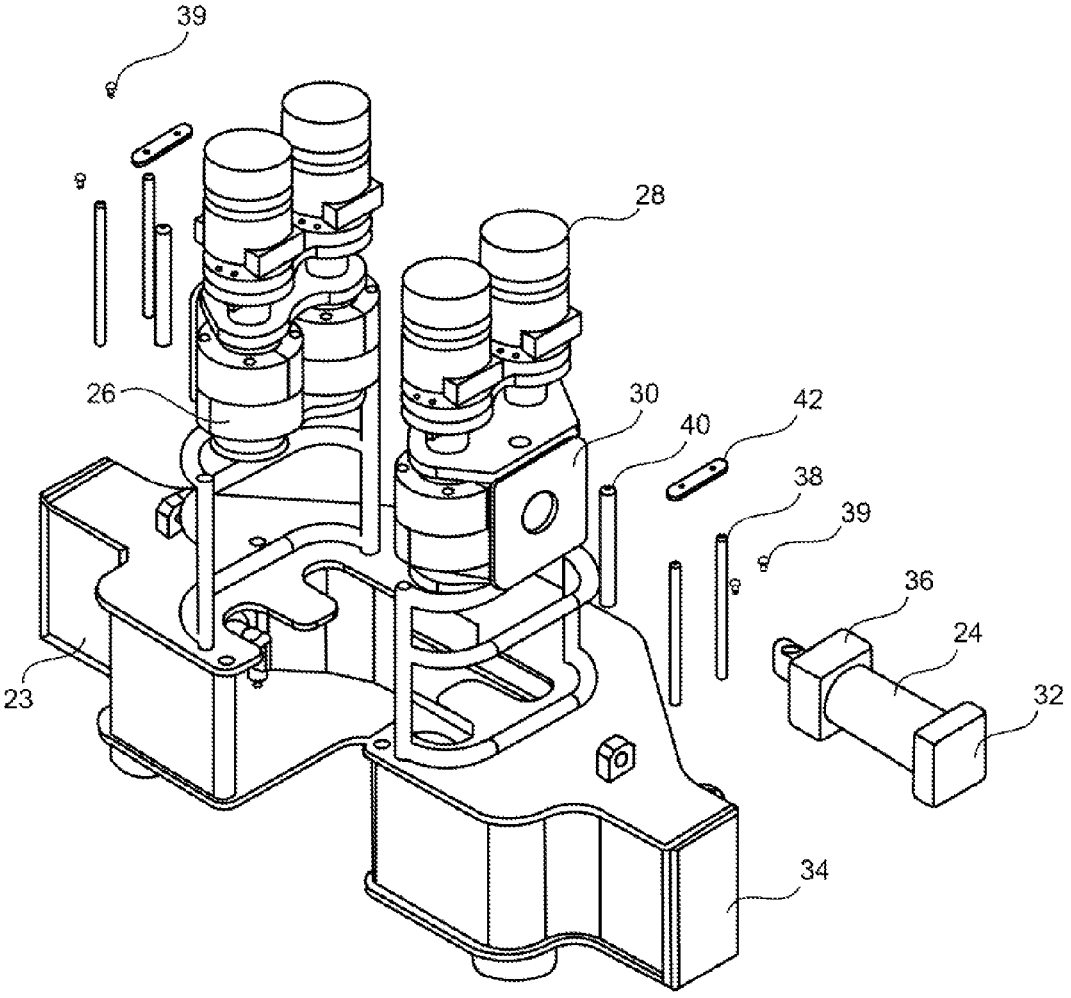
FIG. 2 is an exploded view of the spinner generally shown in FIG. 1.

Referring now to FIG. 2, the spinner 20 generally shown in FIG. 1 is illustrated in greater detail. The spinner comprises a frame 22 which substantially houses a pair of hydraulic cylinders 24, with each hydraulic cylinder axis being substantially aligned and passing through a central axis of the tubular. FIG. 2 also illustrates a plurality of rollers 26 each intended for frictional engagement with an outer surface of the tubular to rotate or spin the tubular. Each roller 26 is powered by a hydraulic drive motor 28, which as shown in FIG. 2 is positioned above the roller and is supported on a bracket 30.

Rearward surface 32 of each cylinder 24 engages an end plate 34 of the housing 22. A radially inward cylinder block 36 retains the cylinder at a fixed location within the housing 22 by engagement with a pair of pins 38, which may be easily removed through a top or bottom surface of the housing 22 to replace the cylinder, if necessary. Plate 42 may be provided on the exterior surface of frame 22 to cover the pins 38, and also has holes to receive fasteners 39. A pin 40 interconnects the cylinder rod 25 with the bracket 30 (see FIG. 4), such that the bracket may rotate relative to the axis of the cylinder.

Figure 3:
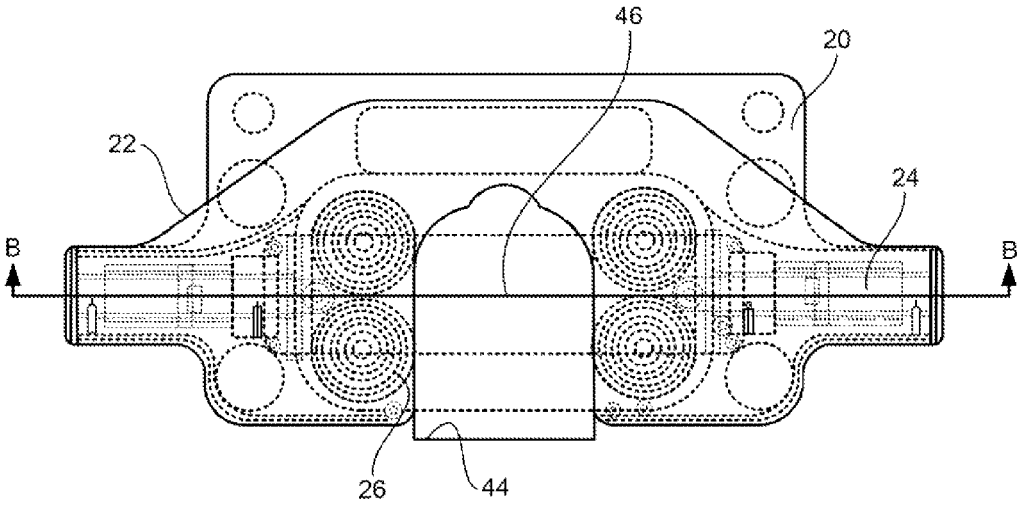
FIG. 3 is a top view of the spinner shown in FIG. 1.
Figure 4:
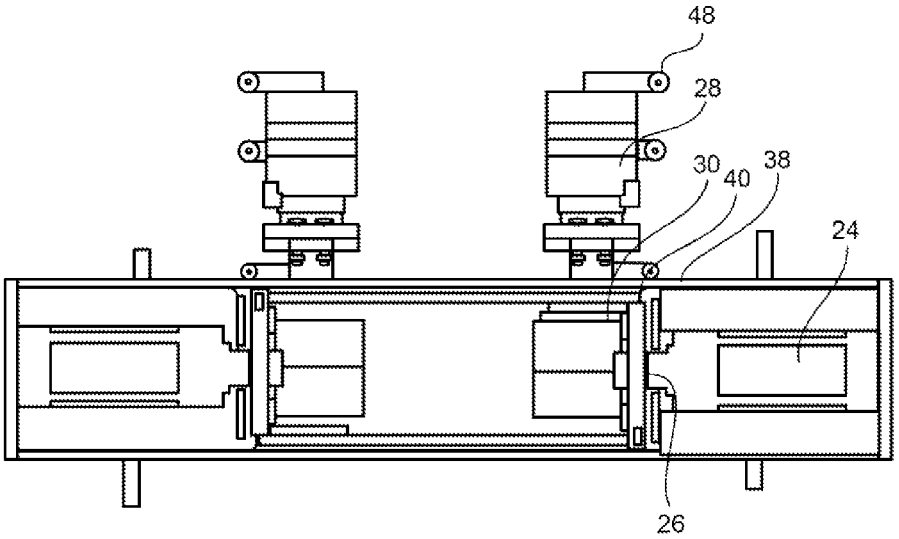
FIG. 4 is a side view of the spinner shown in FIG. 1.

FIG. 3 is a top view of a spinner 20 shown in FIG. 2, illustrating the open throat 44 in the frame 22 for receiving a tubular member therein. Actuation of the cylinders 24 move the rollers 26 inward along common axis 46 to engage the tubular. FIG. 4 illustrates the frame 48 for protecting the motors 28, and further illustrates the pivotal connection of the frame 30 provided by the pin 40 at the rod end of each cylinder 24.

Figure 5:
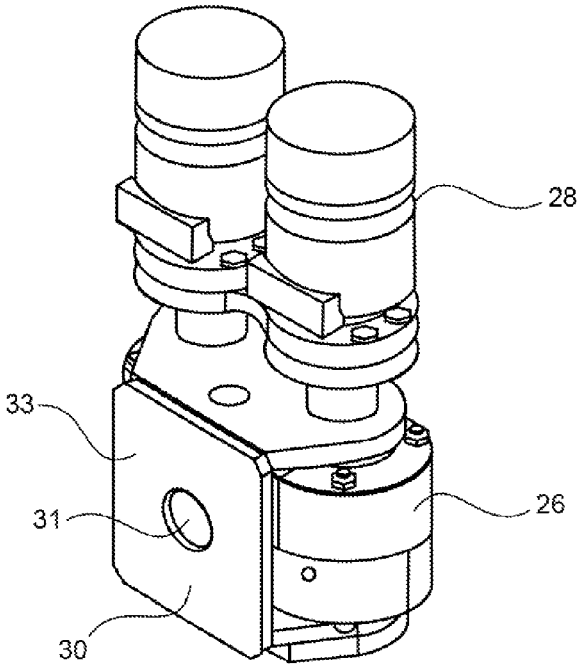
FIG. 5 is a pictorial view of a bracket supporting a pair of rollers and a pair of motors.
Figure 6:
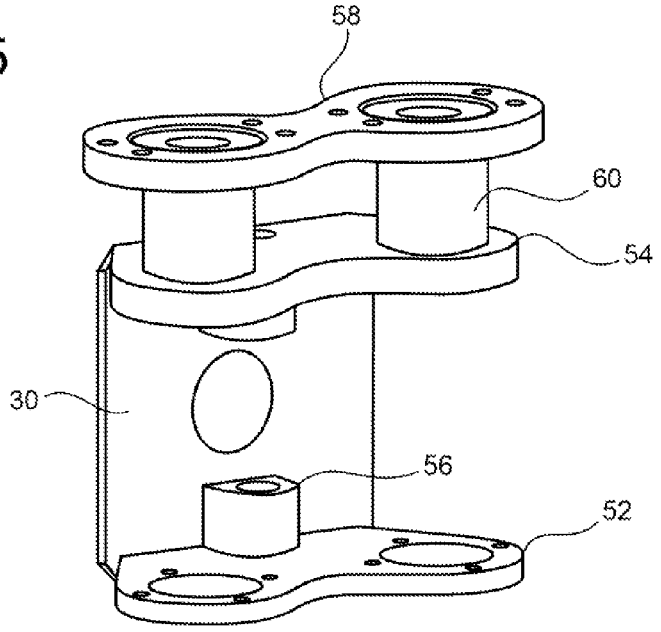
FIG. 6 is a pictorial view of the bracket generally shown in FIG. 5.

FIG. 5 illustrates in greater detail two motors 28, each for powering a respective roller 26, and the bracket 30 for supporting both the rollers and the motors. Bracket 30 includes a hole 31 in the radially outward plate 33 for receiving the rod end of a cylinder, and allows pivoting movement of the bracket 30 with respect to the axis of the cylinder 24. FIG. 6 illustrates in greater detail suitable configuration for the bracket 30, with a lower plate 52 having a pair of apertures each for receiving a respective roller bearing assembly, and a similar cavity in the plate 54 housing an upper bearing assembly. A pair of end caps 56 are provided for rotatably supporting the rod 40, which may be slid into position through a suitable hole in plate 54. Upper plate 58 is supported on a pair of hollow posts 60, which house the drive shafts interconnecting each motor with a respective roller.

Figure 7:
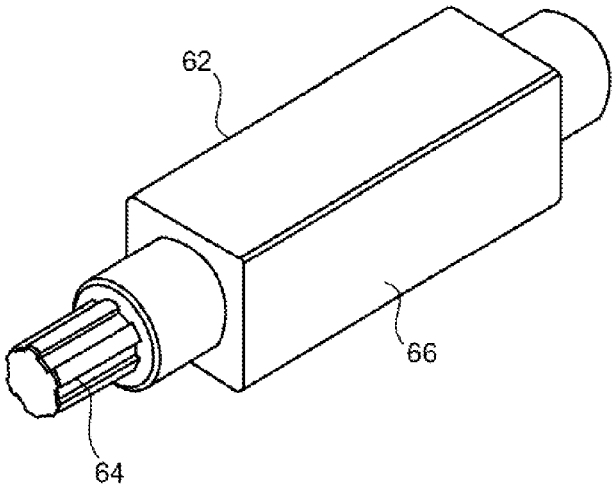
FIG. 7 is a pictorial view of a drive member rotatable by a motor for rotating a respective roller.

FIG. 7 shows a suitable drive shaft 62 having a splined end 64 for coupling to the output shaft of the motor, and an elongate substantially rectangular block 66. As explained subsequently, it is a feature of the invention that the roller have a center passageway with at least a portion having polygonal cross-sectional configuration for receiving an elongate polygonal portion of a drive shaft from the motor. Although a shaft with a square cross-section is depicted, the shaft and the mating passageway in the roller could have a hexagonal or octagonal cross-sectional configuration. In a preferred embodiment, the polygonal configuration of the drive shaft extends at least substantially through the length of the passageway through the roller.

Figure 8:
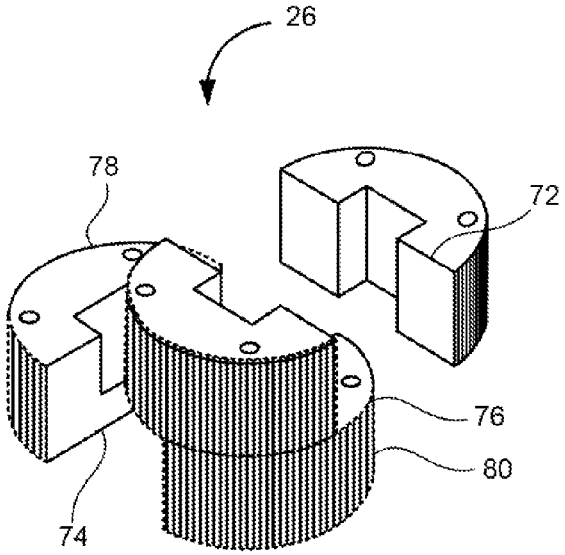
FIG. 8 is a pictorial view of a disassembled roller.
Figure 9:
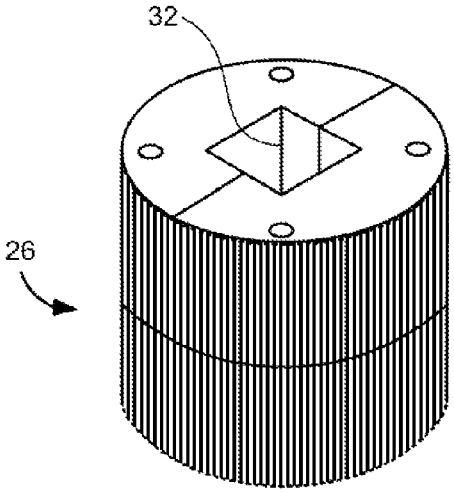
FIG. 9 is a pictorial view of the assembled roller.

FIG. 8 illustrates a roller 26 composed of segments 72, 74 which together form an upper half of the roller, and segments 76 and 78 which together form a lower half of the roller. In a preferred embodiment, each of the segments 72, 74, 76 and 78 is identical in structure, thereby significantly reducing manufacturing costs. Each segment has an outer surface 80 which may be grooved or otherwise profiled for increasing frictional engagement with a tubular. FIG. 9 illustrates a roller 26 having a rectangular passageway 82 extending therethrough for receiving the rectangular block 66 of the drive shaft 62. As shown in FIG. 9, the planar end faces of the arcuate portions engage, and the end surfaces of the lower segments are rotated 90 degrees with respect to the end surfaces of the upper segment. This allows suitable bolts to be passed through the underside of a lower segment and through an aligned bolt hole in the upper segment, and a nut placed on top of the bolt, such that four bolts hold the assembly together, as shown in FIG. 5. During disassembly, the bolts can be removed and one or all of the arcuate segments taken off the drive shaft 62 without removing the motor or the drive shaft.

Figure 10:
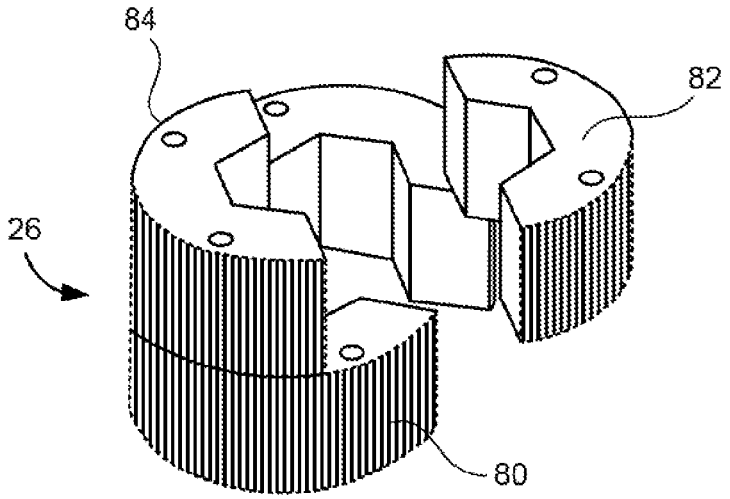
FIG. 10 is pictorial view of another embodiment of a partially disassembled roller.
Figure 11:
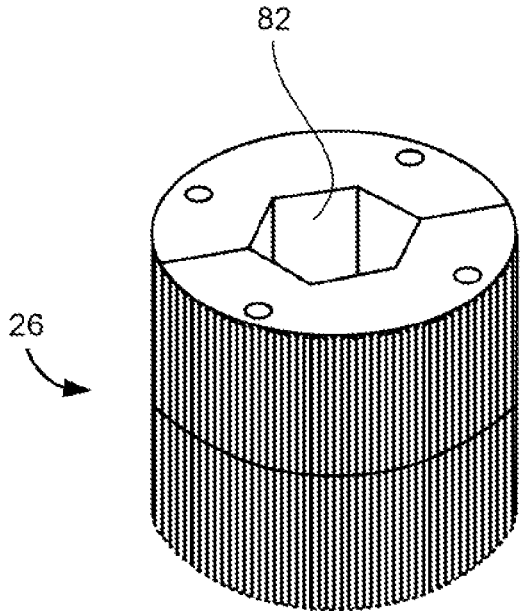
FIG. 11 is a pictorial view of the assembled roller.

FIG. 10 illustrates another embodiment of a roller 26 composed of segments 82 and 84 which together form an upper or a lower half of the roller. Each segment again is preferable identical in structure, and has an outer surface which may be profiled for increasing frictional engagement with the tubular. The FIG. 10 embodiment differs from the FIG. 8 embodiment in that the passageway 82 extending through the roller has substantially a hexagonal cross-sectional configuration. The assembled roller is shown in FIG. 11, and four bolts may be used to hold the roller assembly together.

Figure 12:
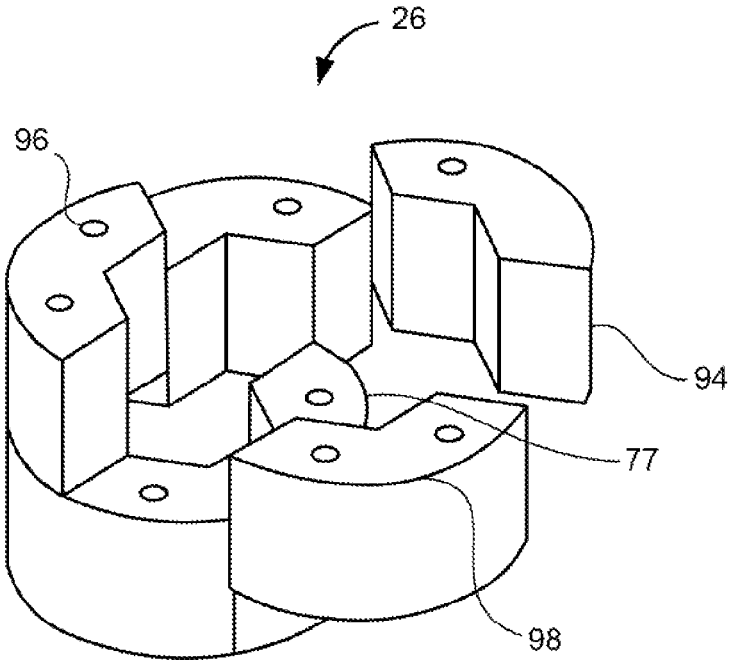
FIG. 12 is a pictorial view of yet another embodiment of a partially disassembled roller.
Figure 13:
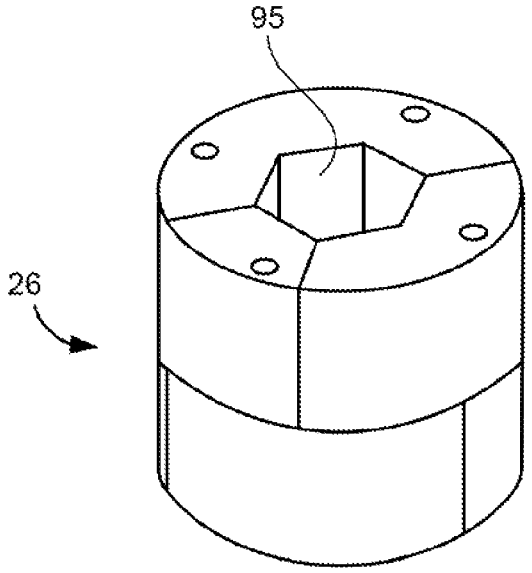
FIG. 13 is a pictorial view of the assembled roller.

FIG. 12 illustrates yet another embodiment of a roller 26 wherein each upper and lower layer is comprised of three segments 94, 96 and 98 which together form the upper or lower half of the roller. As with the other embodiments, the segments are identical in structure and have an outer surface for frictional engagement with a tubular. As shown in FIG. 13, a hexagonal shaped passageway 95 is provided through the roller, and six bolts passing through an underside of the lower segment and through an aligned bolt hole in the upper segment may be used in conjunction with six nuts to hold the assembly together. For this embodiment, the offset angle between planar surfaces would be approximately 60 degrees.

Those skilled in the art will appreciate that each roller may be formed from two or more axially stacked cylindrical portions, with each cylinder portion formed from a pair of arcuate members with end surfaces positioned along a plane that passes substantially through the axis of the roller. A thin pad could be provided between these cylindrical portions to prevent their engagement, with a lower end of the upper cylindrical portion then spaced slightly above the upper end of a lower cylindrical portion.

The pair of arcuate members which form each cylindrical portion preferably have end surfaces in planar engagement, although the end surfaces could be spaced slightly from each other. The end surfaces of the cylindrical portions are circumferentially offset for an assembled roller, such that a plurality of bolts or other securing members may extend between and interconnect the axially spaced cylindrical portions. Each bolt or securing member may be removed from a respective roller through the bottom of the roller, such that the securing member is removed in a direction opposite the motor with respect to the roller.

Figure 14:
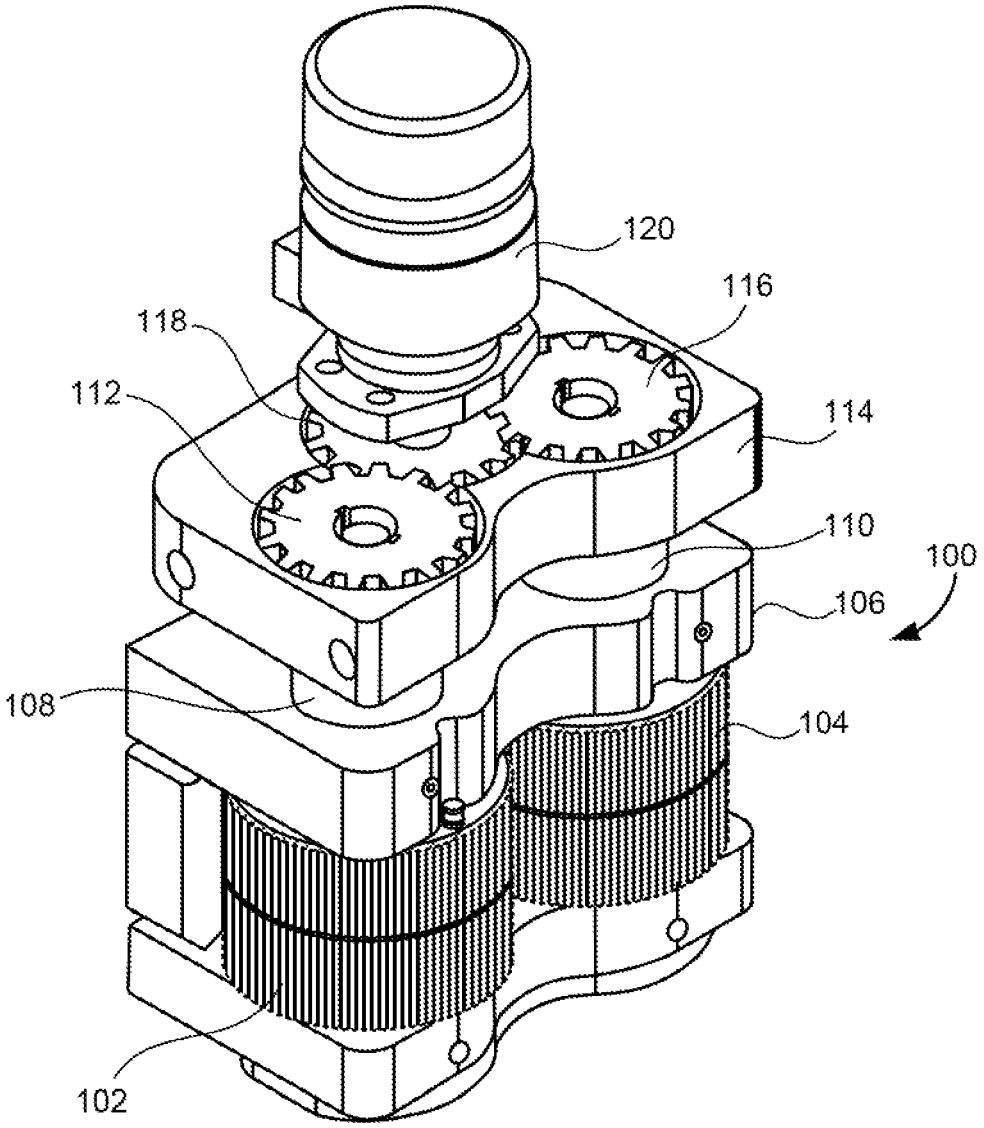
FIG. 14 is a perspective view of an alternative configuration for the driving of the rollers in accordance with the present invention.

FIG. 14 illustrates a configuration of the rollers and driving assembly 100 as used in an alternative embodiment of the present invention. In particular, the assembly 100 includes a first roller 102 and a second roller 104 that are provided in rotatable relationship adjacent to each other. A frame 106 is provided so as to support the shafts 108 and 110 associated with the respective rollers 102 and 104. In particular, the shafts 108 and 110 and can extend through the frame 106 so as to connect with a central passageway of each of the rollers 102 and 104. The shaft 108 includes a gear 112 received within the gearbox 114. Another gear 116 will be connected to the shaft 110 is also received within the gearbox 114. The gears 112 and 116 have teeth extending therefrom. These teeth will engage with another gear 118 that is connected to a motor 120. As such, when the motor 120 rotates the gear 118, the gears 112 and 116 will correspondingly rotate so as to drive the rotation of the shafts 108 and 110 and the respective rollers 102 and 104.

Figure 15:
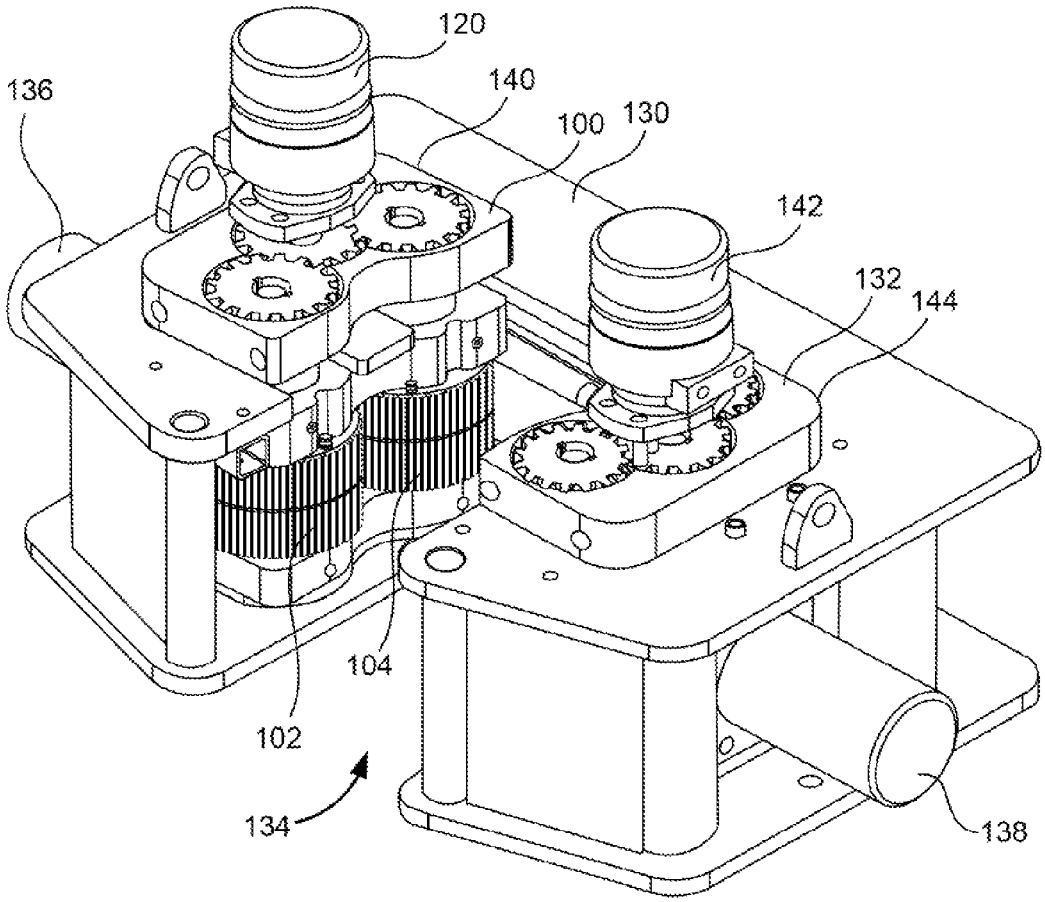
FIG. 15 shows this alternative embodiment of the present invention as used in Association with the actuators and the frame of the spinner assembly.

FIG. 15 shows the spinner housing 130 that serves to receive the assembly 100 and also another spinner assembly 132. As can be seen, the spinner housing 130 defines an open throat 134. The open throat 134 is formed between the spinner assembly 100 and the spinner assembly 132. The spinner assembly 100 has a similar configuration to that described in association with FIG. 14. The spinner assembly 132 will have a corresponding spinner assembly. An actuator 136 serves to drive the rollers 102 and 104 along a common axis. Similarly, an actuator 138 serves to drive the spinners associated with the spinner assembly 132 along such a common axis. As such, the actuators 136 and 138 can be utilized so as to close the respective rollers of the spinner assemblies 100 and 132 upon the exterior surface of a tubular member. As such, the rollers will engage with this exterior surface. After the spinning is completed, the actuators 136 and 138 can move the rollers backwardly along the common axis so as to release the rollers from the exterior surface of the tubular member.

In FIG. 15, it can be seen that the motor 120 along with the gears 112, 116 and 118 are supported upon bracket 140. Bracket 140 is configured so as to slide along with the spinner housing 130. Similarly, the gears associated with the motor 142 of the spinner assembly 132 are positioned on a bracket 144. Once again, the bracket 144, along with its associated components, can move along the common axis about the spinner housing 130.

Figure 16:
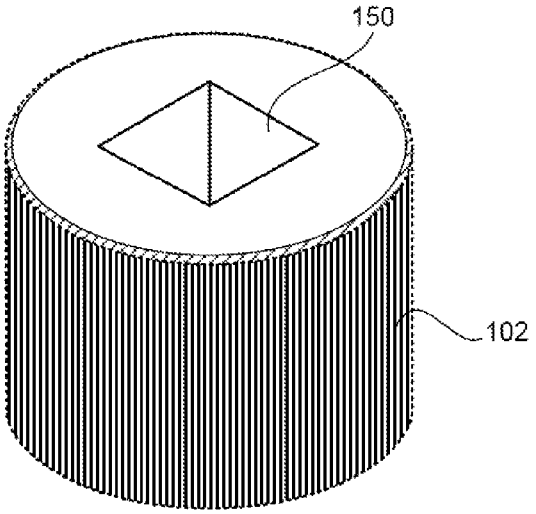
FIG. 16 is a perspective view showing the central passageway of an individual roller.

FIG. 16 illustrates one configuration of the roller 102. It can be seen that roller 132 has teeth formed along an exterior surface thereof. The roller 142 can be a solid roller or it can be a cordless roller. The roller 102 has a central passageway 150 formed therein. Central passageway 150 is of a polygonal shape. In FIG. 16, this polygonal shape is a square configuration. As such, a shaft of a square cross section can be received within the central passageway 150 so as to drive the roller 102.

Figure 17:
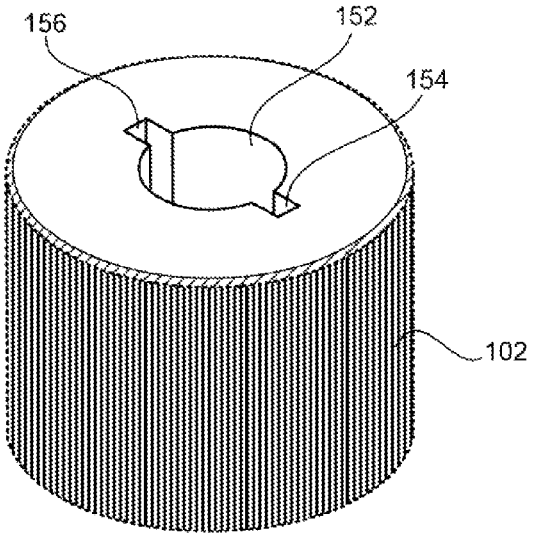
FIG. 17 is a perspective view of an alternative embodiment of the interior passageway of the roller.

FIG. 17 illustrates the roller 102 as having a central passageway 152. The central passageway 152 is of a generally round cross section having a first keyway 154 and a second keyway 156 extending diametrically therefrom. In the configuration of FIG. 17, the roller 102 is suitable for receiving a round shaft therein. Such a round shaft will have outwardly extending keys that are suitable for mating with the keyways 154 and 156 of the central passageway 152.

Figure 18:
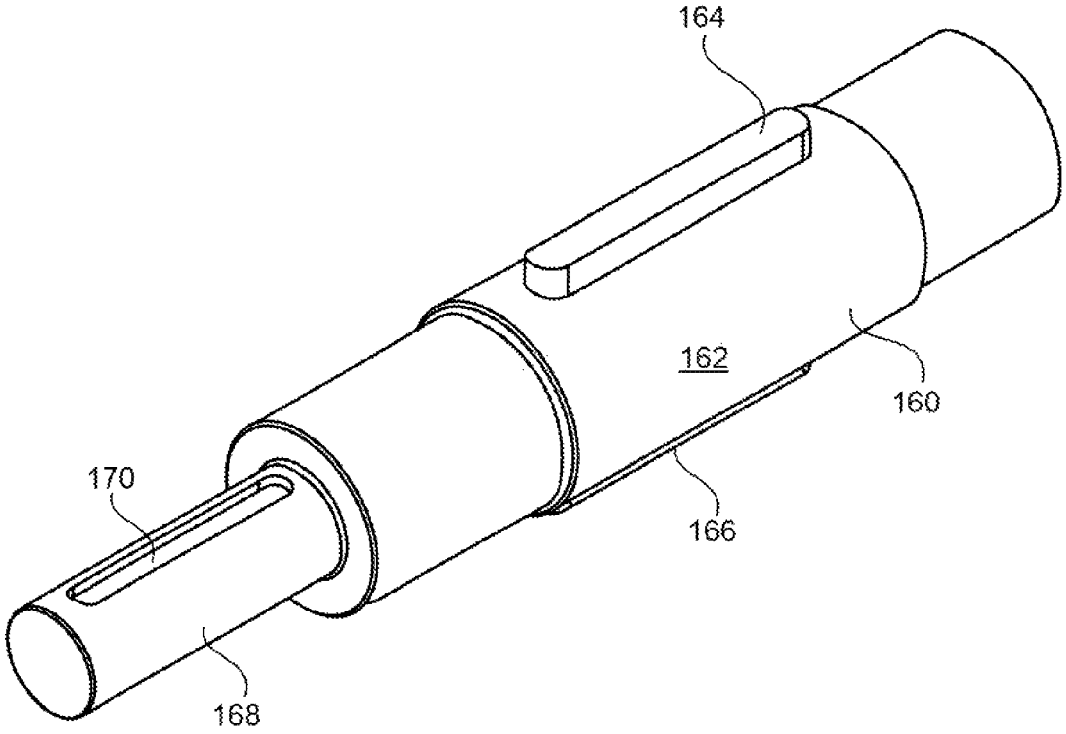
FIG. 18 is a perspective view showing the shaft is used for the driving of the roller of FIG. 17.

FIG. 18 is an illustration of a shaft 160. It can be seen that the shaft 160 has a generally cylindrical exterior surface 162. The exterior surface 162 has a key 164 extending outwardly therefrom. Another key 166 is formed on the opposite side of the exterior surface 162. In normal use, the keys 164 and 166 can be received within the respective keyways 154 and 156 of the roller 102 as shown in FIG. 17. A driving element 168 is located at the end of the shaft 160 so as to be connected to a gear. The outwardly extending portion 166 includes a keyway 170 that can mate with a key associated with a gear or with a motor. As such, a rotation can be imparted by the motor to the shaft 160 so as to drive the roller.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A spinner assembly for threading or unthreading tubular members above a floor at a well site, the spinner assembly comprising:

a spinner housing having an open throat, said open throat suitable for receiving one of the tubular members therein, said spinner housing having a common axis;

a plurality of rollers rotatable about a substantially vertical axis, said plurality of rollers adapted to engage with the tubular member received in said open throat;

a driver cooperative with said plurality of rollers so as to drive said plurality of rollers; and a plurality of brackets supporting said plurality of rollers, the plurality of brackets disposed within said spinner on opposite sides of said open throat, the plurality of brackets being movable inwardly and outwardly of said spinner housing in opposite directions with respect to each other along a substantially straight line along the common axis.

2. The spinner assembly of claim 1, further comprising:

a plurality of actuators respectively connected to said plurality of brackets, the plurality of actuators connected to said spinner assembly and cooperative respectively with the plurality of brackets so as to move the plurality of brackets in a substantially straight line.

3. The spinner assembly of claim 1, said driver comprising:

a motor cooperative with said rollers so as to rotate said rollers.

4. The spinner assembly of claim 1, said driver comprising:

a motor connected to the plurality of rollers by at least one gear.

5. The spinner assembly of claim 1, said driver comprising:

a motor connected by at least one shaft to said plurality of rollers.

6. The spinner assembly claim 5, the shaft having a polygonal-shaped cross-section.

7. The spinner assembly of claim 5, the shaft having a round cross-section.

8. The spinner assembly of claim 7, the shaft having a key extending therefrom, said key engaged with a keyway of a central passageway of the roller.

9. The spinner assembly of claim 5, the roller having a central passageway of a polygonal shape, said shaft having a polygonal shape received within said central passageway of the roller.

10. The spinner assembly of claim 5, the roller having a central passageway of a round shape with a key or a keyway formed therein, said shaft having a key or a keyway formed thereon, said shaft received in said central passageway of the roller such that the key of the shaft is received by the keyway of the roller or such that the key of the roller is received by the keyway of the shaft.

11. The spinner assembly of claim 1, said driver comprising:

a motor connected to said plurality of rollers by plurality of shafts and a plurality of gears.

12. The spinner assembly of claim 1, at least one of said plurality of rollers being a cordless roller.

13. The spinner assembly of claim 1, at least one of said plurality of rollers being a solid roller.

* * * * *